US009039004B2

(12) United States Patent
Iesaki

(10) Patent No.: US 9,039,004 B2
(45) Date of Patent: May 26, 2015

(54) TRANSPORT SYSTEM, IMAGE FORMING SYSTEM, AND CONTROL DEVICE

(71) Applicant: Brother Kogyo Kabushiki Kaisha, Nagoya-shi, Aichi-ken (JP)

(72) Inventor: Kenichi Iesaki, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/308,947

(22) Filed: Jun. 19, 2014

(65) Prior Publication Data

US 2015/0061207 A1 Mar. 5, 2015

(30) Foreign Application Priority Data

Aug. 30, 2013 (JP) ..... 2013-179782

(51) Int. Cl.

| | |
|---|---|
| ***B65H 7/20*** | (2006.01) |
| ***B65H 5/06*** | (2006.01) |
| ***B65H 7/02*** | (2006.01) |
| ***B65H 5/34*** | (2006.01) |

(52) U.S. Cl.

CPC ..... *B65H 7/20* (2013.01); *B65H 5/068* (2013.01); *B65H 7/02* (2013.01); *B65H 5/34* (2013.01)

(58) Field of Classification Search

CPC .. B65H 23/192; B65H 23/18; B65H 23/1888; B65H 7/20; B65H 2513/104; B65H 2513/106; B65H 2553/51; B65H 2557/20

See application file for complete search history.

(56) References Cited

U.S. PATENT DOCUMENTS

| | | | |
|---|---|---|---|
| 5,794,927 | A | 8/1998 | Uchida |
| 8,616,671 | B2 | 12/2013 | Lawther et al. |
| 2011/0056796 | A1 | 3/2011 | Takeda et al. |

FOREIGN PATENT DOCUMENTS

| | | | |
|---|---|---|---|
| JP | 2000-310928 | | 11/2000 |
| JP | 2006-008322 | | 1/2006 |
| JP | 2013-072749 | A | 4/2013 |
| JP | 2013-072750 | A | 4/2013 |
| JP | 2014-196184 | | 10/2014 |
| JP | 2014-197319 | | 10/2014 |

OTHER PUBLICATIONS

Notice of Allowance issued in corresponding U.S. Appl. No. 14/069,420 mailed Jul. 9, 2014.

Jul. 30, 2014—(EP) Extended EP Search Report—App 13191289.1.

(Continued)

*Primary Examiner* — Michael McCullough

(74) *Attorney, Agent, or Firm* — Banner & Witcoff, Ltd.

(57) ABSTRACT

There is provided a transport system including: a transport mechanism including first and second rollers; first and second driving devices; first and second measuring devices configured to measure a state quantities Z1 and Z2; and a controller configured to control the first and second driving devices. The controller is configured to perform: estimating reaction forces R1 and R2; calculating control inputs U1 and U2; inputting, to the first driving device, a control signal in accordance with a sum of the control input U1 and the control input U2; inputting, to the second driving device, a control signal in accordance with a difference between the control input U1 and the control input U2; estimating non-tensional components RE1 or RE2; and correcting the control input U2 to prevent a control error caused by the non-tensional components RE1 and RE2 included in an estimated tension of the sheet (R1−R2)/2.

13 Claims, 10 Drawing Sheets

(56) References Cited

OTHER PUBLICATIONS

Jul. 31, 2014—(EP) Extended EP Search Report—App 14172442.7.
Nov. 1, 2013—(US) Co-pending U.S. Appl. No. 14/069,420.
Nov. 1, 2013—(US) Co-pending U.S. Appl. No. 14/069,683.
Mar. 29, 2013—(JP) Pending Application 2013-072749.
Mar. 29, 2013—(JP) Pending Application 2013-072750.

TRANSPORT SYSTEM, IMAGE FORMING SYSTEM, AND CONTROL DEVICE

CROSS REFERENCE TO RELATED APPLICATION

The present application claims priority from Japanese Patent Application No. 2013-179782, filed on Aug. 30, 2013, the disclosure of which is incorporated herein by reference in its entirety.

BACKGROUND OF THE INVENTION

1. Field of the Invention

The present invention relates to a transport system, an image forming system, and a control device.

2. Description of the Related Art

As a transport system transporting a sheet, there is conventionally known a system including a plurality of rollers arranged along a transport path of the sheet. According to the transport system, the sheet is transported downstream in the transport path with rotations of the rollers. The control of transporting the sheet is achieved by controlling a common motor which drives the plurality of rollers to rotate and/or motors each of which drives one of the plurality of rollers individually. This type of transport system is mounted in an image forming system such as an ink-jet printer.

Further, also as the transport system, there is known a system which sends out a sheet, which is convolved or rolled into a roll, to the downstream side of a transport path. For example, there is known such a system which includes a send-out roller provided to send out the sheet rolled into the roll, and a transport roller provided on the downstream side from the send-out roller (see Japanese Patent Application Laid-open No. 2006-008322).

This transport system controls the speed of the sheet by controlling the send-out roller and the transport roller. Further, the transport system controls the tension of the sheet by controlling the send-out roller while carrying out a correction in which the tension of the sheet is considered.

SUMMARY OF THE INVENTION

In the above technique, however, the driving control for adjusting the speed of the sheet is performed for the plurality of rollers. However, the driving control for adjusting the tension of the sheet is performed only for the send-out roller in the plurality of rollers. Therefore, there is a problem such that it is difficult to control the tension with high accuracy.

In particular, in a system transporting a short sheet such as a paper sheet of a standard size, if the sheet is subjected to an excessive load, slippage will occur between the rollers and the sheet. Hence, it is difficult to control properly by a conventional way in which the sheet tension is controlled with only one roller while controlling a state quantity of the sheet (position, speed, acceleration, or the like.).

The present invention has been made taking the foregoing problem into consideration, an object of which is to provide a technique which is capable of controlling a state quantity and tension of a sheet with high accuracy in a system in which the sheet is transported by using a plurality of rollers.

A transport system of the present teaching includes a transport mechanism provided with a first roller and a second roller which are arranged apart from each other along a transport path of a sheet. The sheet is transported with rotations of the first and second rollers in a predetermined transport direction. The transport system further includes a first driving device, a second driving device, a first measuring device, a second measuring device, and a control device.

The first driving device drives and rotates the first roller, and the second driving device drives and rotates the second roller. The first measuring device measures a state quantity Z1 concerning a rotary motion of the first roller, and the second measuring device measures a state quantity Z2 concerning a rotary motion of the second roller.

The control device controls an operation of transporting the sheet with rotations of the first roller and the second roller by controlling the first driving device and the second driving device. The control device includes a first estimating unit, a second estimating unit, a first computing unit, a second computing unit, a first driving control unit, and a second driving control unit.

The first estimating unit estimates a reaction force R1 acting on the first roller in a case that the first roller is driven to rotate by the first driving device, and the second estimating unit estimates a reaction force R2 acting on the second roller in a case that the second roller is driven to rotate by the second driving device.

The first computing unit calculates a control input U1 in accordance with a deviation between a target state quantity and a state quantity of the sheet (Z1+Z2)/2, based on the state quantity Z1 measured by the first measuring device and the state quantity Z2 measured by the second measuring device.

The second computing unit calculates a control input U2 in accordance with a deviation between a target tension and an estimated tension of the sheet (R1−R2)/2, based on the reaction force R1 estimated by the first estimating unit and the reaction force R2 estimated by the second estimating unit.

The first driving control unit controls the first driving device by inputting, to the first driving device, a control signal in accordance with a sum (U1+U2) of the control input U1 and the control input U2. The second driving control unit controls the second driving device by inputting, to the second driving device, a control signal in accordance with a difference (U1−U2) between the control input U1 and the control input U2.

As described above, according to the transport system of the present teaching, the control input U1 for controlling the state quantity of the sheet and the control input U2 for controlling the tension of the sheet are calculated. Then, the control signal in accordance with the sum (U1+U2) of the control input U1 and the control input U2 is input to the first driving device, and the control signal in accordance with the difference (U1−U2) between the control input U1 and the control input U2 is input to the second driving device.

According to the present teaching, the state quantity of the sheet is controlled properly according to the component U1 included in the control input (U1+U2) for the first driving device and the control input (U1−U2) for the second driving device. Further, the tension of the sheet is controlled properly according to the component +U2 included in the control input for the first driving device and the component −U2 included in the control input for the second driving device. Therefore, the sheet can be transported by two rollers while the state quantity and tension of the sheet are controlled with high accuracy, and it is possible to establish a transport system with high performance.

However, each of the reaction forces R1 and R2 estimated by one of the first and second estimating units may include a component (non-tensional component) other than the reaction force caused by the tension of the sheet. In a case that each of the reaction forces R1 and R2 includes the non-tensional component, the non-tensional component may cause a control error concerning at least one of the speed and the tension.

In view of this, the control device can include a third estimating unit estimating the non-tensional component RE1 or the non-tensional component RE2. The non-tensional component RE1 referred herein is a component included in the reaction force R1 estimated by the first estimating unit and unrelated to the tension of the sheet. The non-tensional component RE2 is a component included in the reaction force R2 estimated by the second estimating unit and unrelated to the tension of the sheet.

The third estimating unit may be configured to estimate the non-tensional component RE1 or the non-tensional component RE2 based on the reaction force R1 or the reaction force R2 estimated during a period of time in which the sheet is transported by only one of the first roller and second roller from among the first roller and the second roller.

In particular, the third estimating unit may be configured to estimate the non-tensional component RE1 based on the reaction force R1 estimated by the first estimating unit during a period of time in which the sheet is transported only by the first roller from among the first roller and the second roller. Alternatively, the third estimating unit may be configured to estimate the non-tensional component RE2 based on the reaction force R2 estimated by the second estimating unit during a period of time in which the sheet is transported only by the second roller from among the first roller and the second roller.

The second computing unit may be configured to correct the control input U2 so as to prevent a control error caused by the non-tensional component RE1 and the non-tensional component RE2 based on the non-tensional component RE1 or the non-tensional component RE2 estimated by the third estimating unit.

In particular, the second computing unit may be configured to correct the control input U2 so as to prevent the control error caused by the non-tensional component RE1 and the non-tensional component RE2 included in the estimated tension of the sheet (R1−R2)/2, during a period of time in which the sheet is transported by both of the first roller and the second roller. The correction of the control input U2 can be achieved, for example, by directly correcting the control input U2 or correcting a parameter used for the calculating process of the control input U2. According to this transport system, it is possible to suppress the control error caused by including the non-tensional components RE1, RE2 in the reaction forces R1 and R2 estimated by the first and second estimating units.

The transport system as described above may be incorporated into an image forming system. In particular, the image forming system may be configured to include not only the abovementioned transporting system, but also an image forming device provided above the transporting path of the sheet to form an image on the sheet by jetting ink droplets. The first roller and the second roller are arranged, for example, across a section which is defined within the transporting path and above which the image forming device is provided.

When the ink droplets are jetted from a jetting portion of the image forming device to form the image on the sheet, if the speed and/or tension of the sheet cannot be controlled, the change in speed and/or flexure of the sheet may cause a deviation in the landing points of the ink droplets, and thereby the quality of the image formed on the sheet may be deteriorated. According to the image forming system of the present teaching, it is possible to suppress the degradation in image quality.

Further, the present teaching may be configured as a control device controlling an operation of transporting a sheet by controlling a first driving device configured to drive and rotate a first roller and a second driving device configured to drive and rotate a second roller, in a transport mechanism achieving the operation of transporting the sheet with rotations of the first roller and the second roller which are arranged apart from each other along a transporting path of the sheet.

This control device may be constructed by, for example, a computer. In this case, the computer executes a program to achieve the functions of the aforementioned respective units included in the control device. This program can be provided in such a manner as recorded in a computer-readable recording medium typified by a magnetic disk including flexible disks and the like, an optical disk including DVD and the like, and a semiconductor memory including flash memory and the like. Or, the control device may be configured as a dedicated circuit.

DESCRIPTION OF THE EMBODIMENTS

Figure 1:
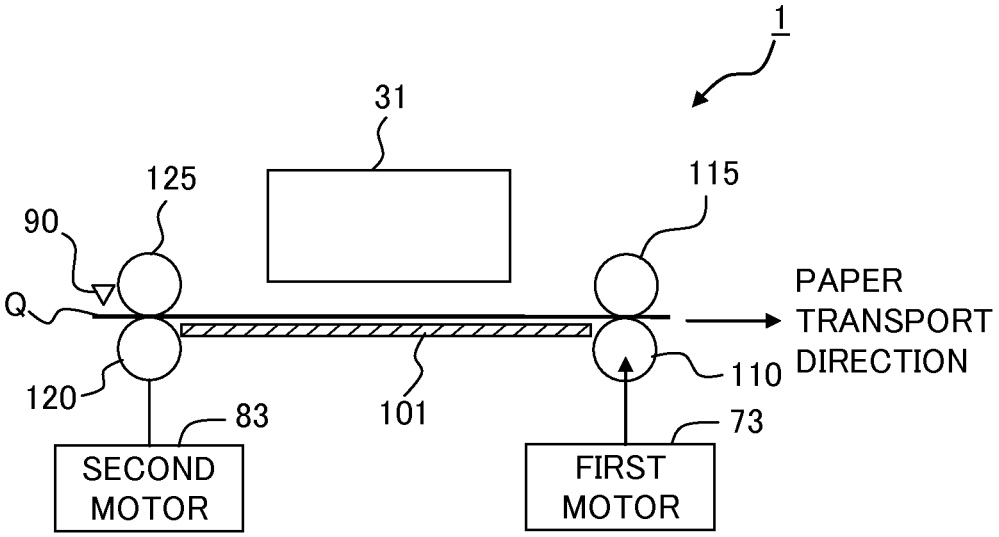
FIG. 1 shows a structure of the periphery of a paper transport path in an image forming system.

Hereinbelow, embodiments of the present teaching will be described while referring to the accompanying drawings. An image forming system 1 of this embodiment shown in FIG. 1 is an ink jetprinter, which includes an ink-jet head 31 arranged above a platen 101 forming a transport path for a sheet of paper Q.

Ink droplets are discharged from the lower surface of the ink jethead 31 toward the paper Q passing through over the platen 101. This discharge operation forms an image on the paper Q. The ink-jet head 31 has a shape elongated in a line direction (a direction perpendicular to the plane-of-paper of FIG. 1) and is configured to form the image in the line direction on the entire area of the paper Q passing through over the platen 101.

A conventional ink-jet printer forms the image in the line direction by causing the ink-jet head to jet ink droplets while scanning the ink jethead in the line direction at a constant speed with the paper Q standing still. After forming the image, the ink-jet printer sends the paper Q by a predetermined quantity or length to the downstream side. By repetitively carrying out such kind of operation, the image is formed on the paper Q.

In contrast to this, the image forming system 1 of this embodiment forms the image on the paper Q by discharging the ink droplets from the long ink jethead 31 while transporting the paper Q at a constant speed in a transport direction, instead of transporting the paper Q intermittently.

In the image forming system 1, the paper Q is transported from the upstream side to the downstream side of the transport path along the platen 101 with rotations of a first roller 110 and a second roller 120. The first roller 110 is arranged to face a first driven roller 115 on the downstream side of the platen 101. The second roller 120 is arranged to face a second driven roller 125 on the upstream side of the platen 101.

The first roller 110 transports the paper Q downstream by its rotation with the paper Q being pinched or nipped between itself and the first driven roller 115. The first roller 110 is driven to rotate by a first motor 73 which is a DC motor. The second roller 120 transports the paper Q downstream by its rotation with the paper Q being pinched or nipped between the second roller 120 and the second driven roller 125. The second roller 120 is driven to rotate by a second motor 83 which is a DC motor in the same manner as the first motor 73.

That is, the first roller 110 and the second roller 120 are arranged at two points apart from each other across the platen 101 along the transport path. The image forming system 1 transports the paper Q downstream in a state that the paper Q is nipped by the first roller 110 and the second roller 120 at the two points separated in the transport direction. The image forming system 1 drives and rotates the first motor 73 and the second motor 83 from a stage prior to supplying the paper Q to the second roller 120, thereby rotating the first roller 110 and the second roller 120 at a constant speed. Then, with the first roller 110 and the second roller 120 rotating at the constant speed, the paper Q is supplied from the upstream side of the second roller 120 to the second roller 120.

Figure 2:
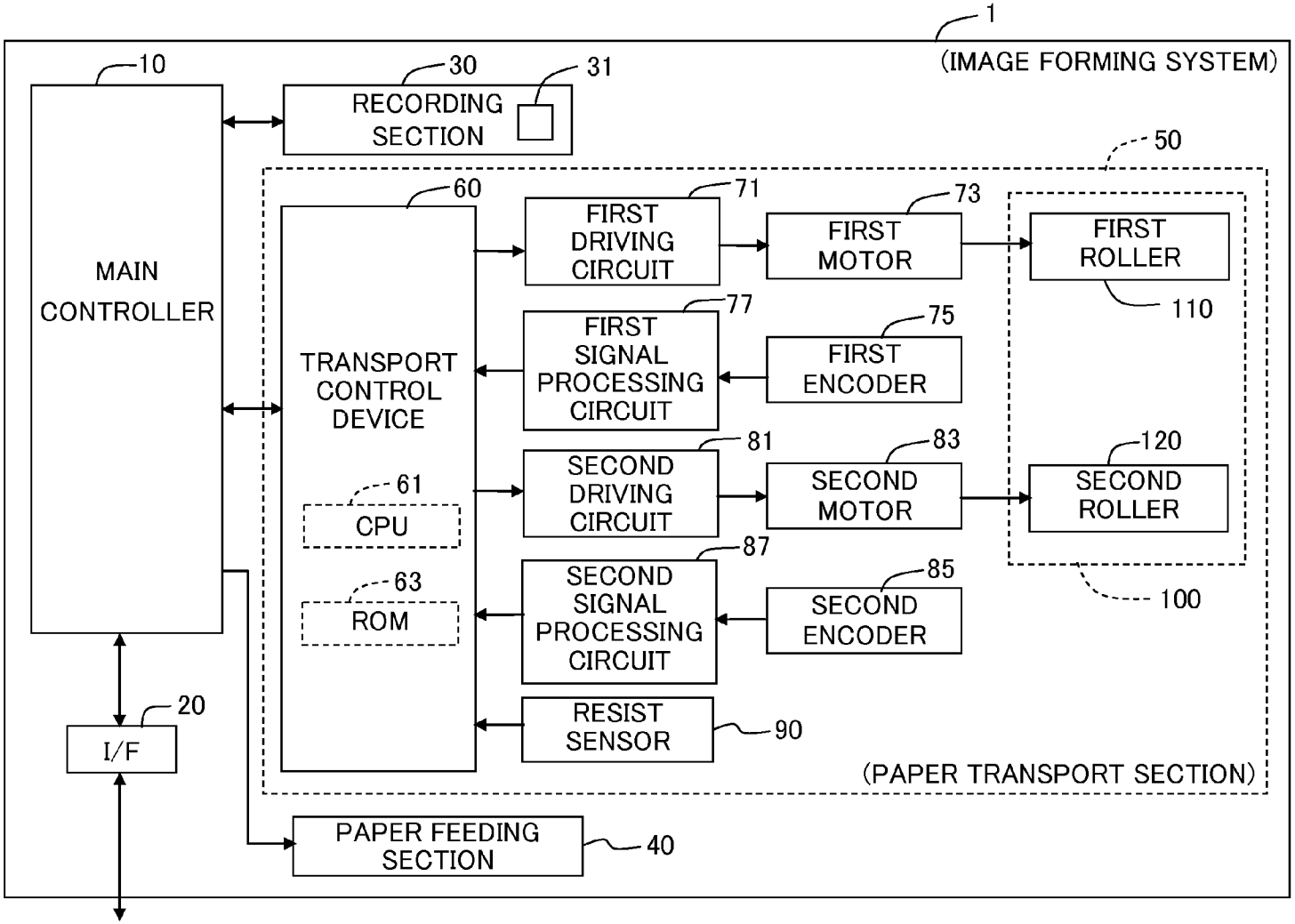
FIG. 2 is a block diagram showing an overall construction of the image forming system.

As shown in FIG. 2, the image forming system 1 of this embodiment includes a main controller 10, a communication interface 20, a recording section 30, a paper feeding section 40, and a paper transport section 50. A transport mechanism 100 for the paper Q includes the first roller 110, the first driven roller 115, the second roller 120, the second driven roller 125, and the platen 101. The transport mechanism 100 is provided in the paper transport section 50.

The main controller 10 includes a microcomputer and the like to control the image forming system 1 as a whole. The communication interface 20 is an interface for the communications between the main controller 10 and external devices such as a personal computer. The main controller 10 receives image data to be printed from an external device via the communication interface 20, and controls the recoding section 30, the paper feeding section 40, and the paper transport section 50 to form the image on the paper Q based on the image data to be printed.

The recording section 30 primarily includes the ink jethead 31 and a driving circuit therefor (not shown). Based on the instruction from the main controller 10, the recording section 30 drives the ink-jet head 31 to form the image on the paper Q based on the image data to be printed. The paper feeding section 40 includes a paper feeding roller, a paper feeding tray, and the like which are all not shown. Based on the instruction from the main controller 10, the paper feeding section 40 supplies the paper Q to the second roller 120 from the upstream side.

The paper transport section 50 includes the transport mechanism 100, a transport control device 60, a first driving circuit 71, the first motor 73, a first encoder 75, a first signal processing circuit 77, a second driving circuit 81, the second motor 83, a second encoder 85, a second signal processing circuit 87, and a resist sensor 90.

The first driving circuit 71 is a circuit for driving the first motor 73. The first driving circuit 71 drives the first motor 73 in accordance with a pulse width modulation signal (hereinafter referred to as a PWM signal) as a control signal input from the transport control device 60. In this case, the first motor 73 is driven by a driving current corresponding to the duty ratio of the PWM signal. The first motor 73 is driven by the first driving circuit 71 to rotate the first roller 110.

The first encoder 75 is a rotary encoder which outputs a pulse signal each time the first roller 110 rotates through a predetermined angle. The first encoder 75 is provided at a position to be able to observe the rotary motion of the first roller 110 directly or indirectly. For example, the first encoder 75 is arranged at the rotating shaft of the first roller 110 or the rotating shaft of the first motor 73. Like a well-known rotary encoder, the first encoder 75 outputs, as the pulse signal, an A-phase signal and a B-phase signal which are different in phase from each other. Hereinbelow, these signals will be expressed collectively as an encoder signal.

The encoder signal output from the first encoder 75 is input to the first signal processing circuit 77. Based on this encoder signal, the first signal processing circuit 77 measures a rotation amount X1 and a rotation speed V1 of the first roller 110, and inputs the information of the measured rotation amount X1 and rotation speed V1 to the transport control device 60.

The second driving circuit 81 is a circuit for driving the second motor 83. The second driving circuit 81 drives the second motor 83 by the driving current corresponding to the duty ratio of another PWM signal, according to the PWM signal input from the transport control device 60. The second motor 83 is driven by the second driving circuit 81 to rotate the second roller 120.

The second encoder 85 is another rotary encoder which outputs, as the encoder signal (A-phase signal and B-phase signal), a pulse signal each time the second roller 120 rotates through a predetermined angle. The second encoder 85 is provided at a position at which the second encoder 85 is able to observe the rotary motion of the second roller 120.

The encoder signal output from the second encoder 85 (A-phase signal and B-phase signal) is input to the second signal processing circuit 87. Based on this encoder signal, the second signal processing circuit 87 measures a rotation amount X2 and a rotation speed V2 of the second roller 120, and inputs the information of the measured rotation amount X2 and rotation speed V2 to the transport control device 60. The resist sensor 90 is provided at a point in the vicinity of the second roller 120 on the upstream side of the second roller 120 to input, to the transport control device 60, a signal indicating that the paper Q has passed through the point.

The transport control device 60 controls the first motor 73 and the second motor 83 by outputting the PWM signals. The transport control device 60 calculates a control input for the first motor 73 (first control input Us) and a control input for the second motor 83 (second control input Ud), and inputs the PWM signals corresponding to these control inputs to the first driving circuit 71 and the second driving circuit 81, respectively. By performing the PWM control for the first motor 73 and the second motor 83 as described above, the transport control device 60 controls the transport operation of the paper Q by the rotations of the first roller 110 and the second roller 120.

In particular, the transport control device 60 controls the first motor 73 and the second motor 83 so that the paper Q is transported at a constant speed over the platen 101. Further, the transport control device 60 controls the first motor 73 and the second motor 83 so that the paper Q is transported with an appropriate tension when the paper Q is transported while receiving forces from both of the first roller 110 and the second roller 120.

Figure 3:
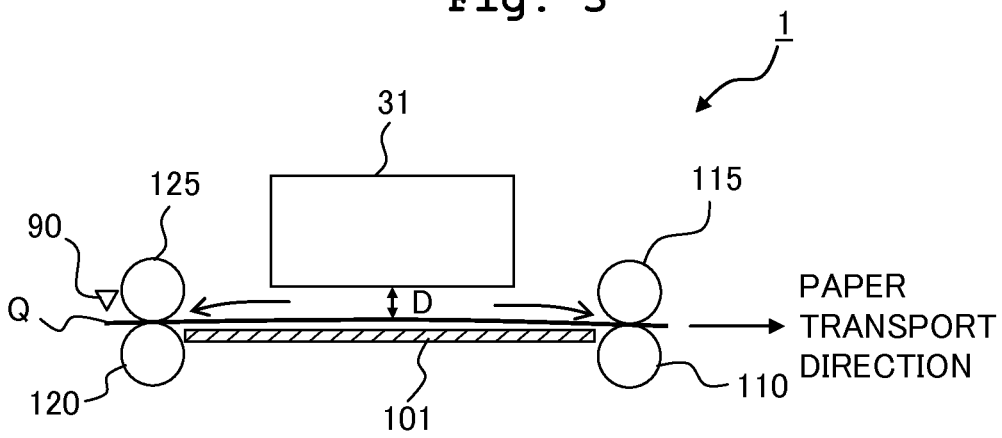
FIG. 3 is a diagram showing a change in the distance between the lower surface of an ink-jet head and the surface of a sheet of paper, due to flexure of the paper.

The following is the reason for carrying out such a motor control in which the tension is considered. According to this embodiment, the individual motors 73 and 83 are used respectively to rotate the first roller 110 and the second roller 120. Therefore, when carrying out the motor control without considering the tension, the paper Q is more likely to be flexed or warped over the platen 101 as shown in FIG. 3. Furthermore, because the flexure is not definite, the change in the gap D between the lower surface of the ink-jet head 31 and the surface of the paper Q is more likely to occur.

In this embodiment, ink droplets are discharged from the ink jethead 31 while transporting the paper Q. Therefore, when the gap D changes, the landing points of the ink droplets jetted from the ink-jet head 31 will deviate from the intended points on the paper Q. Such deviation of the landing points negatively affects the quality of the image formed on the paper Q. Because of this reason, the transport control device 60 controls the first motor 73 and the second motor 83 so as to control both of the speed and the tension of the paper Q.

Figure 4:
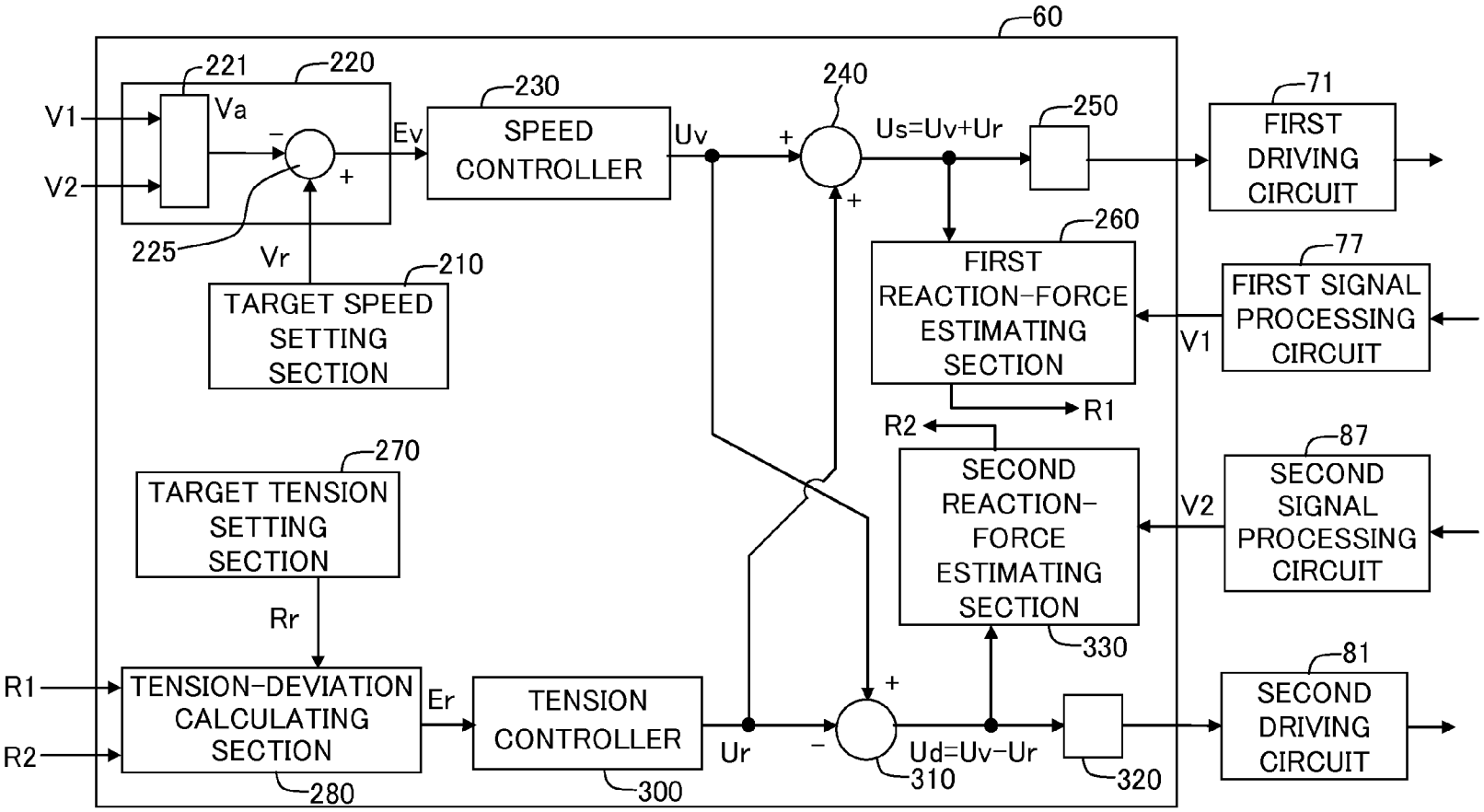
FIG. 4 is a block diagram showing a detailed configuration of a transport control device.

Next, a detail configuration of the transport control device 60 will be explained. As shown in FIG. 4, the transport control device 60 includes a target speed setting section 210, a speed deviation calculating section 220, a speed controller 230, a first control input calculating section 240, a first PWM signal generating section 250, a first reaction-force estimating section 260, a target tension setting section 270, a tension deviation calculating section 280, a tension controller 300, a second control input calculating section 310, a second PWM signal generating section 320, and a second reaction-force estimating section 330.

The target speed setting section 210 sets a target speed Vr for the paper Q. The target speed setting section 210 sets a fixed value as the target speed Vr for each point of time in order to transport the paper Q at a constant speed.

The speed deviation calculating section 220 includes a paper speed calculating section 221 and a subtractor 225. The paper speed calculating section 221 calculates the average value (V1+V2)/2 of the rotation speed V1 measured by the first signal processing circuit 77 and the rotation speed V2 measured by the second signal processing circuit 87 as an estimated speed Va of the paper Q. The subtractor 225 calculates the deviation Ev (=Vr−Va) between the target speed Vr set by the target speed setting section 210 and the estimated speed Va. The speed deviation calculating section 220 inputs the calculated deviation Ev to the speed controller 230.

The speed controller 230 calculates a control input Uv corresponding to the deviation Ev according to a predetermined transfer function G obtained on the basis of a transfer model of a controlled object. The control input Uv is a control input for controlling the speed of the paper Q to be at the target speed Vr. The controlled object mentioned here is the sum of a first controlled object and a second controlled object, and the transfer function G is based on the transfer model corresponding to the sum of the first controlled object and the second controlled object. A transmission system of the first controlled object is the first driving circuit 71, the first motor 73, the first roller 110, the first encoder 75, and the first signal processing circuit 77. A transmission system of the second controlled object is the second driving circuit 81, the second motor 83, the second roller 120, the second encoder 85, and the second signal processing circuit 87.

The speed controller 230 calculates the control input Uv according to the transfer function G so that the speed of the paper Q pursues or follows the target speed Vr. In particular, the speed controller 230 calculates the driving current, as the control input Uv, which should be applied to the first motor 73 and the second motor 83.

The target tension setting section 270 sets a target tension Rr for the paper Q. The target tension setting section 270 sets a predetermined target tension Rr to a nonzero value so that the paper Q is transported with an appropriate tension when both the first roller 110 and the second roller 120 transport the paper Q. The target tension Rr is set to zero when the paper Q is not transported by both the first roller 110 and the second roller 120.

The tension deviation calculating section 280 calculates a value Er which corresponds to a deviation between an estimated tension Ra and the target tension Rr of the paper Q, based on a reaction force R1 estimated by the first reaction-force estimating section 260, a reaction force R2 estimated by the second reaction-force estimating section 330, and the target tension Rr set by the target tension setting section 270. The value Er is input to the tension controller 300. The estimated tension Ra is calculated, for example, as the value (R1−R2)/2, which corresponds to the difference (R1−R2) between the reaction force R1 estimated by the first reaction-force estimating section 260 and the reaction force R2 estimated by the second reaction-force estimating section 330. The value Er (hereinafter expressed simply as a deviation Er) is calculated, for example, as Er=Rr−Ra.

The first reaction-force estimating section 260 estimates the reaction force R1 acting on the first roller 110 when it is driven to rotate by the first motor 73, while the second reaction-force estimating section 330 estimates the reaction force R2 acting on the second roller 120 when it is driven to rotate by the second motor 83. The reaction forces R1 and R2 take on positive or negative values according to the direction of the acting force. In the present description, the reaction force acting in the opposite direction to the transport direction of the paper Q takes on a positive value, whereas the reaction force acting in the same direction as the transport direction of the paper Q takes on a negative value.

As it will be described later, the tension deviation calculating section 280 has a function to correct the deviation Er from the value (Rr−Ra) by taking non-tensional components RE1, RE2 included in the estimated reaction forces R1, R2 into consideration.

The tension controller 300 calculates a control input Ur corresponding to the deviation Er input from the tension deviation calculating section 280 according to a predetermined transfer function H obtained on the basis of a transfer model of a controlled object. The control input Ur is a control input for controlling the tension of the paper Q to be at the target tension Rr. The controlled object mentioned here is the difference between the first controlled object and the second controlled object, and the transfer function H is based on the transfer model corresponding to the difference between the first controlled object and the second controlled object.

The tension controller 300 calculates the control input Ur according to the transfer function H so that the tension of the paper Q may pursue or follow the target tension Rr. In particular, the tension controller 300 calculates, as the control input Ur, the driving current which should be applied to the first motor 73 and the second motor 83.

The first control input calculating section 240 calculates, as the first control input Us, the sum (Uv+Ur) of the control input Uv calculated by the speed controller 230 and the control input Ur calculated by the tension controller 300. The first control input Us (=Uv+Ur) corresponds to the control input for the first motor 73, in other words, an electric-current command value for the first driving circuit 71.

The second control input calculating section 310 calculates, as the second control input Ud, the difference (Uv−Ur) between the control input Uv calculated by the speed controller 230 and the control input Ur calculated by the tension controller 300. The second control input Ud (=Uv−Ur) corresponds to the control input for the second motor 83, in other words, an electric-current command value for the second driving circuit 81.

As described above, the transport control device 60 calculates the sum of the control input Uv and the control input Ur as the first control input Us, and calculates the difference between the control input Uv and the control input Ur as the second control input Ud. Hereinbelow, an explanation will be made on the reason thereof. In order to generate a tension in the paper Q, it is necessary for the first motor 73 to adjust the driving current so that the force greater than the force needed for speed control by the amount of the tension acts on the first roller 110 from the first motor 73. On the other hand, the tension applies a negative reaction force to the second roller 120. The negative reaction force is reaction force to pull the second roller 120 in the transporting direction. Therefore, it is necessary for the second motor 83 to adjust the driving current so that the force smaller than the force originally needed for speed control by the amount of the tension acts on the second roller 120 from the second motor 83. For the above reason, the transport control device 60 calculates the sum of the control input Uv and the control input Ur as the first control input Us, and calculates the difference between the control input Uv and the control input Ur as the second control input Ud.

The first PWM signal generating section 250 generates a PWM signal having the duty ratio to drive the first motor 73 by the driving current corresponding to the first control input Us calculated in the above manner, and inputs the same to the first driving circuit 71. According to this PWM signal, the first driving circuit 71 drives the first motor 73 by the driving current corresponding to the first control input Us.

The second PWM signal generating section 320 generates a PWM signal having the duty ratio which is set so as to drive the second motor 83 by the driving current corresponding to the second control input Ud, and inputs the PWM signal to the second driving circuit 81. According to this PWM signal, the second driving circuit 81 drives the second motor 83 by the driving current corresponding to the second control input Ud.

Further, the first reaction-force estimating section 260 estimates the reaction force R1 acting on the first motor 73 based on the first control input Us calculated by the first control input calculating section 240, and the rotation speed V1 measured by the first signal processing circuit 77. On the other hand, the second reaction-force estimating section 330 estimates the reaction force R2 acting on the second motor 83 based on the second control input Ud calculated by the second control input calculating section 310, and the rotation speed V2 measured by the second signal processing circuit 87.

Hereinbelow, an explanation will be given about detailed configurations of the first reaction-force estimating section 260 and the second reaction-force estimating section 330. However, the first reaction-force estimating section 260 and the second reaction-force estimating section 330 respectively estimate the reaction forces R1 and R2 using an identical principle. Therefore, in the following description, the detailed configuration of the first reaction-force estimating section 260 will be explained as the representative. The second reaction-force estimating section 330 estimates the reaction force R2 using the same principle as the first reaction-force estimating section 260, while using the second control input Ud and the rotation speed V2, instead of the first control input Us and the rotation speed V1.

Figure 5:
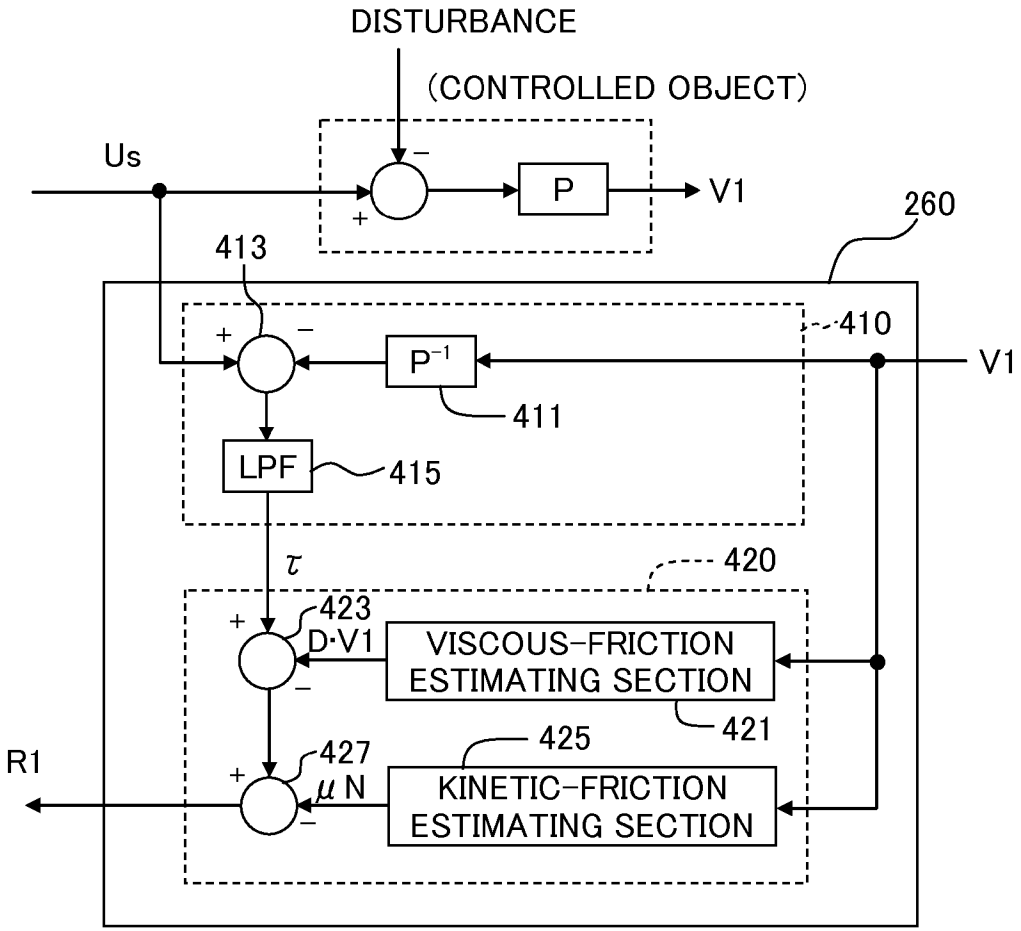
FIG. 5 is a block diagram showing a configuration of a first reaction-force estimating section.

As shown in FIG. 5, the first reaction-force estimating section 260 includes a disturbance observer 410 and an estimating section 420. As is well known, the disturbance observer 410 estimates disturbance acting on the controlled object. The disturbance observer 410 includes an inverse model computing section 411, a subtractor 413, and a low-pass filter 415.

The inverse model computing section 411 converts the rotation speed V1 measured by the first signal processing circuit 77 into the corresponding control input U* by using a transfer function $P^{-1}$ of the inverse model corresponding to the transfer model of the aforementioned first controlled object. The subtractor 413 calculates the deviation (Us−U*) between the first control input Us input to the first motor 73 and the control input U* calculated by the inverse model computing section 411.

The low-pass filter 415 removes the high-frequency component from the deviation (Us−U*). The disturbance observer 410 outputs the deviation (Us−U*), from which the high-frequency component has been removed by the low-pass filter 415, as a disturbance estimated value τ. Considering that the first control input Us is an electric-current command value, let the unit of the deviation (Us−U*) be ampere. Here, when a driving source is a DC motor, a proportional relation is established between ampere and the torque (reaction force). Hence, the deviation (Us−U*) indirectly indicates a force acting on the controlled object as the disturbance.

Based on the disturbance estimated value τ, the estimating section 420 estimates the reaction force R1 caused by the tension of the paper Q. The disturbance estimated value τ includes a viscous friction component and a kinetic friction component brought about by the rotation. The estimating section 420 estimates the reaction force R1 by removing the viscous friction component and kinetic friction component from the disturbance estimated value τ.

In particular, the estimating section 420 includes a viscous friction estimating section 421 and a subtractor 423. The viscous friction estimating section 421 sets, as an estimated value of the viscous friction force, the value (D×V1) which is obtained by multiplying the rotation speed V1 measured by the first signal processing circuit 77 by a predetermined coefficient D. The subtractor 423 calculates the disturbance estimated value after removing the viscous friction component τ1=(τ−D×V1), by subtracting the estimated value of the viscous friction force (D×V1) from the disturbance estimated value τ.

Further, the estimating section 420 includes a kinetic friction estimating section 425 and a subtractor 427. When the rotation speed V1 measured by the first signal processing circuit 77 is zero, the kinetic friction estimating section 425 sets zero as an estimated value of the kinetic friction force, whereas when the rotation speed V1 measured by the first signal processing circuit 77 is not zero, the kinetic friction estimating section 425 sets a predetermined nonzero value μN as the estimated value of the kinetic friction force. The subtractor 427 removes the kinetic friction component from the disturbance estimated value τ1 by subtracting the estimated value of the kinetic friction force (zero or μN) set by the kinetic friction estimating section 425 from the disturbance estimated value τ1. The estimating section 420 estimates the value calculated by the subtractor 427 as the reaction force R1 acting on the first roller 110.

The second reaction-force estimating section 330 converts the rotation speed V2 measured by the second signal processing circuit 87 into the control input U* by using the transfer function of the inverse model corresponding to the aforementioned second controlled object. In order to estimate the viscous friction force and the kinetic friction force, a predetermined coefficient and a predetermined value each corresponding to the second controlled object are used.

According to this embodiment, the tension deviation calculating section 280 has a function to estimate the non-tensional components RE1, RE2 included in the reaction forces R1 and R2. Therefore, the first reaction-force estimating section 260 may be configured not to include the estimating section 420. The first reaction-force estimating section 260 may be configured to output the disturbance estimated value τ1, which is the output of the low-pass filter 415, as the reaction force R1. The second reaction-force estimating section 330 may be configured similarly to the first reaction-force estimating section 260.

Figure 6A:
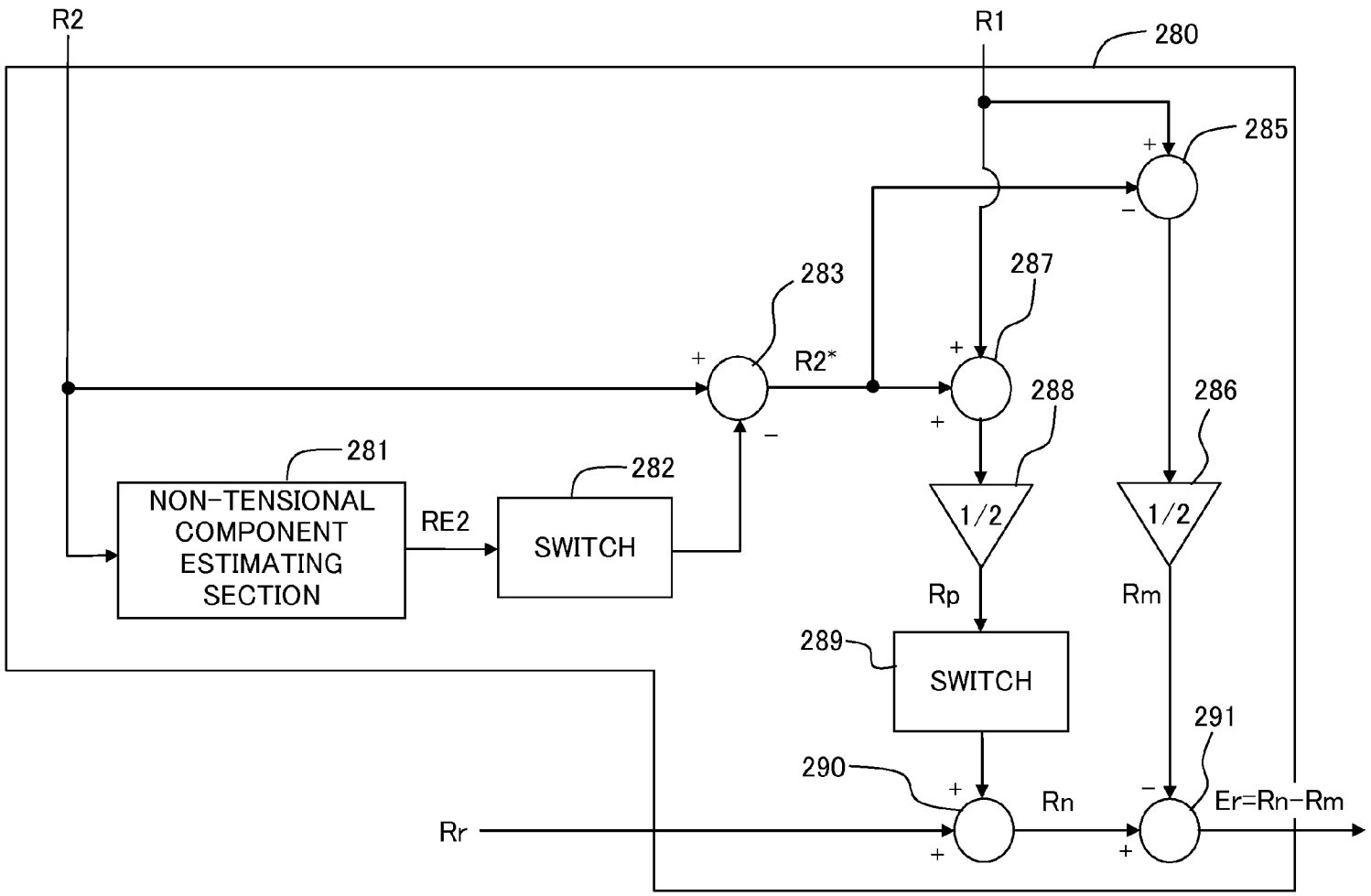
FIGS. 6A and 6B are block diagrams each showing a configuration of a tension deviation calculating section.
Figure 6B:
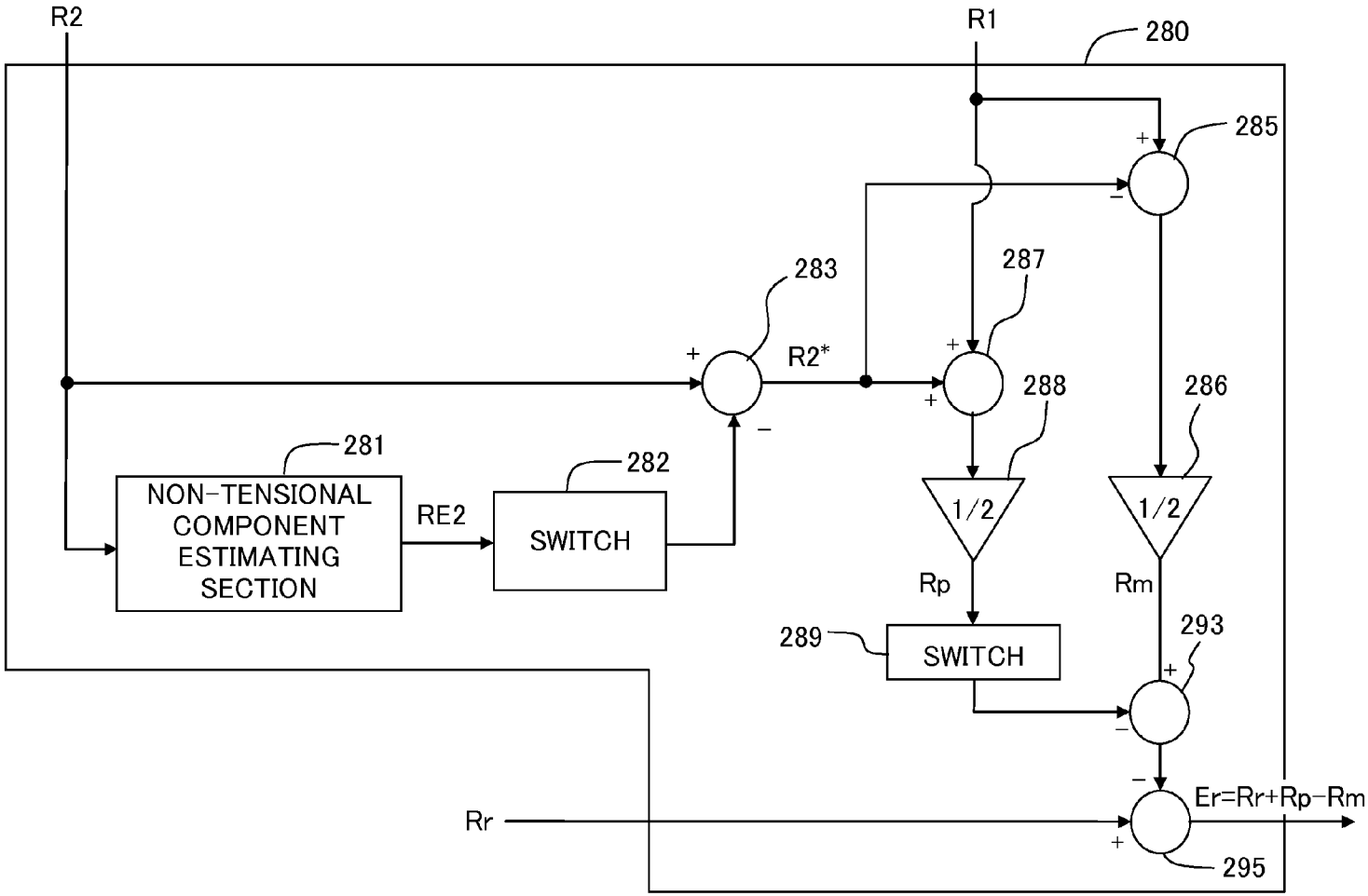

Subsequently, a detail configuration of the tension deviation calculating section 280 will be explained. FIG. 6A shows a first example of the tension deviation calculating section 280, and FIG. 6B is a block diagram showing a second example of the tension deviation calculating section 280. The tension deviation calculating section 280 shown in FIG. 6A as the first example includes a non-tensional component estimating section 281, switches 282, 289, subtractors 283, 285, 291, adders 287, 290, and gain elements 286, 288.

The non-tensional component estimating section 281 estimates the non-tensional component RE2 included in the reaction force R2 during a period of time after the paper Q is started to be transported by the second roller 120 upon the supply of the paper Q to the second roller 120 from the paper feeding section 40 until the front end of the paper Q arrives at the first roller 110 (hereinafter referred to as "second roller transport period") based on the reaction force R2 estimated by the second reaction-force estimating section 330.

In particular, the non-tensional component estimating section 281 statistically processes, at a point in time of completion of the second roller transport period, a group of the reaction forces R2 estimated at respective points of time during the second roller transport period, and then calculates a representative value for the group of the reaction forces R2. The representative value is estimated as the non-tensional component RE2. It is possible to adopt any of an average value, a median value, and a mode value as the representative value. Alternatively, the non-tensional component estimating section 281 may be configured to estimate the reaction force R2 estimated immediately before the completion of the second roller transport period (in other words, the reaction force R2 which is last estimated in the second roller transport period) as the non-tensional component RE2.

The switch 282 inputs the value 0 to the subtractor 283 as the non-tensional component RE2 during a period of time after the control for transporting the paper Q is started and before the estimation of the non-tensional component RE2 performed by the non-tensional component estimating section 281 at or immediately before the completion of the second roller transport period is completed. The switch 282 inputs the non-tensional component RE2 estimated by the non-tensional component estimating section 281 to the subtractor 283 during a transport period using both rollers after the end of the second roller transport period. The transport period using both rollers is a period of time in which the paper Q is transported by both of the first roller 100 and the second roller 120. The transport period using both rollers corresponds to a period of time after the front end of the paper Q has arrived at the first roller 110 before the rear end of the paper Q passes through the second roller 120.

The switch 282 inputs the value 0 to the subtractor 283 as the non-tensional component RE2 during a first roller transport period subsequent to the transport period using both rollers. The first roller transport period corresponds to a period of time in which the paper Q is transported only by the first roller 110 from among the first roller 110 and the second roller 120.

The subtractor 283 inputs, to the subtractor 285 and the adder 287, the reaction force with correction R2*=R2−RE2 obtained by reducing the non-tensional component RE2 input from the switch 282 from the reaction force R2 estimated by the second reaction-force estimating section 330. The reaction force with correction R2* corresponds to a value obtained by removing the non-tensional component RE2 from the reaction force R2. However, in a case that the value 0 is input from the switch 282 as the non-tensional component RE2, the reaction force with correction R2* coincides with the reaction force R2 estimated by the second reaction-force estimating section 330.

The subtractor 285 inputs, to the gain element 286, the value (R1−R2*) which is obtained by subtracting the reaction force with correction R2* from the reaction force R1 estimated by the first reaction-force estimating section 260. The gain element 286 outputs the value Rm=(R1−R2*)/2 corresponding to half of the input value (R1−R2*) and inputs the value Rm to the subtractor 291. The value Rm corresponds to an estimated tension of the paper Q from which the non-tensional components RE1 is not removed.

The adder 287 inputs, to the gain element 288, the sum (R1+R2*) of the reaction force R1 estimated by the first reaction-force estimating section 260 and the reaction force with correction R2*. The gain element 288 outputs the value Rp=(R1+R2*)/2 corresponding to half of the input value (R1+R2*), and inputs the value Rp to the switch 289. The tensional component included in the reaction force R1 adopts the same value as the tensional component included in the reaction force R2, the value of the tensional component included in the reaction force R1 being opposite in sign to the value of the tensional component included in the reaction force R2. Thus, the value Rp corresponds to half of the non-tensional components RE1 included in the reaction force R1.

Similar to the switch 282, the switch 289 outputs the value Rp=0 before the end of the second roller transport period, outputs the value Rp=(R1+R2*)/2 input from the gain element 288 in the transport period using both rollers subsequent to the second roller transport period, and outputs the value Rp=0 in the first roller transport period subsequent to the transport period using both rollers. Each output of the switch 289 is input to the adder 290.

The adder 290 inputs, to the subtractor 291, the value (Rr+Rp) which is obtained by adding the target tension Rr set by the target tension setting section 270 to the value Rp input from the switch 289, as a target tension with correction Rn. The subtractor 291 inputs, to the tension controller 300, the value (Rn−Rm) as the deviation Er. The value (Rn−Rm) is obtained by subtracting the value Rm input from the gain element 286 from the target tension with correction Rn.

The calculation of the deviation Er as described above is equivalent to the following process. That is, the estimated tension Ra of the paper Q (Ra=(R1−R2)/2) is corrected to the estimated tension from which the non-tensional components RE1, RE2 have been removed {(R1−RE1)−(R2−RE2)}/2, and the deviation Er=Rr−{(R1−RE1)−(R2−RE2)}/2 between the estimated tension with correction {(R1−RE1)−(R2−RE2)}/2 and the target tension Rr is calculated.

In the tension deviation calculating section 280 as the first example, as described above, the deviation Er is corrected from the value (Rr−Ra) by taking the non-tensional components RE1, RE2 included in the reaction forces R1, R2 into consideration in the transport period using both rollers, and the deviation with correction Er=Rn−Rm is input to the tension controller 300.

The tension deviation calculating section 280 as the second example has substantially the same structure as that of the tension deviation calculating section 280 as the first example. The second example has the same characteristic as the first example in that the deviation Er=Rn−Rm is input to the tension controller 300. The second example is different from the first example in that subtractors 293, 295 are provided instead of the adder 290 and the subtractor 291.

In the tension deviation calculating section 280 as the second example, the output of the gain element 286 and the output of the switch 289 are input to the subtractor 293. That is, the value (Rm−Rp) is calculated in the subtractor 293. The calculation of the value (Rm−Rp) corresponds to the process in which the estimated tension Ra of the paper Q (Ra=(R1−R2)/2) is corrected to the estimated tension from which the non-tensional components RE1, RE2 have been removed {(R1−RE1)−(R2-RE2)}/2.

The subtractor 295 inputs, to the tension controller 300, the deviation Er=Rr−(Rm−Rp)=Rn−Rm obtained by subtracting the value (Rm−Rp) which is input from the subtractor 293 and corresponds to the estimated tension with correction, from the target tension Rr set by the target tension setting section 270.

The tension controller 300 calculates the control input Ur corresponding to this deviation Er. By removing the error caused by the non-tensional components RE1, RE2 from the deviation Er=Rr−Ra in accordance with the above approach or technique, the control input Ur is corrected to prevent a control error caused by the non-tensional components RE1, RE2 included in the estimated tension Ra of the paper Q (Ra=(R1−R2)/2) in the transport period using both rollers. Therefore, the speed of the paper Q is controlled to the target speed Vr properly, and the tension of the paper Q is controlled to the target tension Rr properly.

Figure 7:
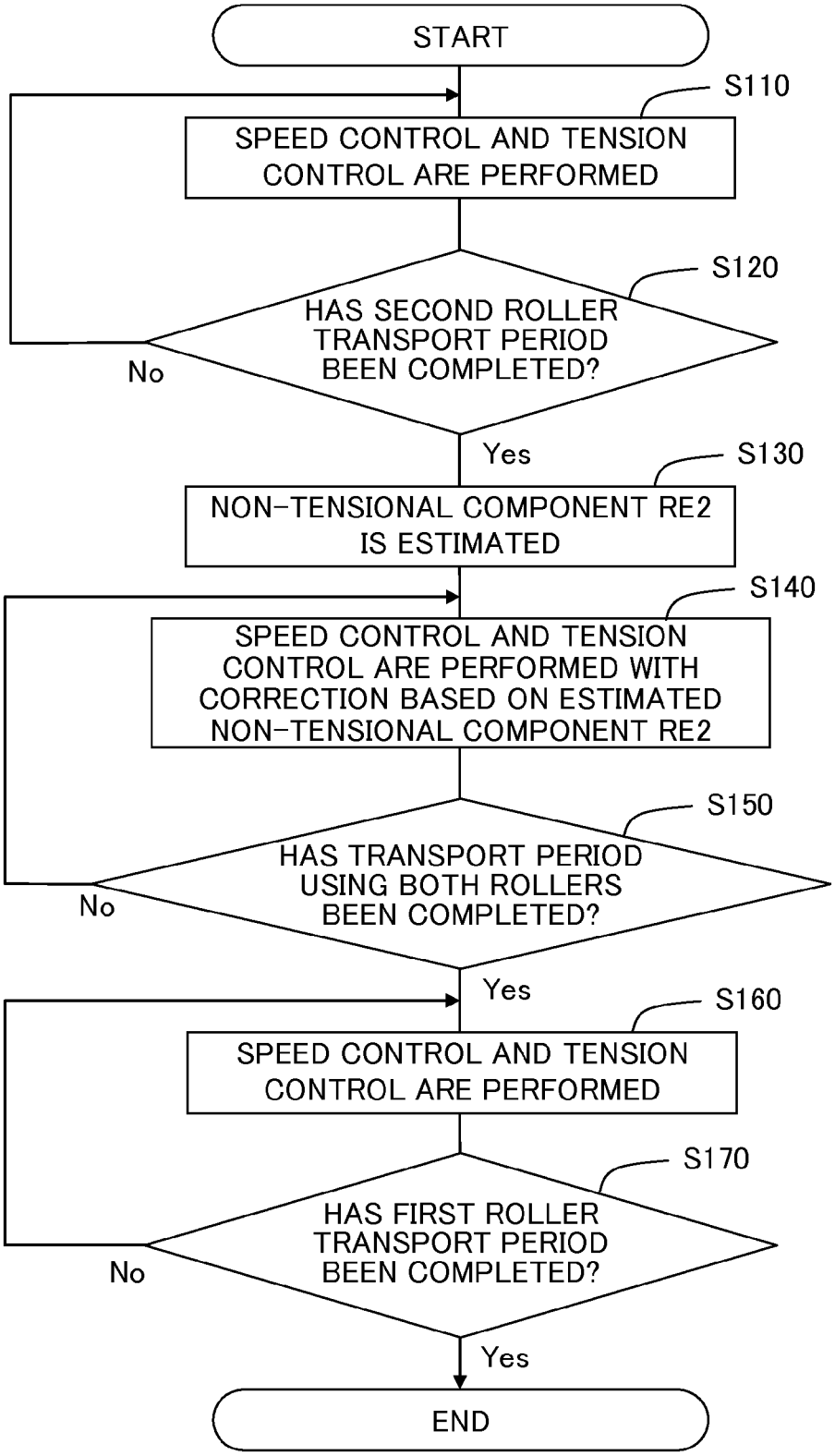
FIG. 7 is a flowchart exemplifying a control process performed by the transport control device.

Here, an explanation will be made about a control process by the transport control device 60 while referring to a flowchart shown in FIG. 7. In a case that the paper transportation by the paper feeding section 40 is started, the transport control device 60 starts the process shown in FIG. 7 to control the transport operation of the paper Q with the rotations of the first roller 110 and the second roller 120 by performing the PWM control for the first motor 73 and the second motor 83.

In particular, before the end of the second roller transport period (S120: No), the deviation Er=Rr−(R1−R2)/2 is calculated by using the reaction force R1 estimated by the first reaction-force estimating section 260 and the reaction force R2 estimated by the second reaction-force estimating section 330, and the control input Ur based on the deviation Er is calculated. Further, the deviation Ev=Vr−(V1+V2)/2 is calculated by using the rotation speed V1 measured by the first signal processing circuit 77 and the rotation speed V2 measured by the second signal processing circuit 87, and the control input Uv based on the deviation Ev is calculated. The first control input Us and the second control input Ud are calculated based on the control inputs Uv, Ur, and the speed and tension for the paper Q are controlled to the target speed Vr and the target tension Rr=0 by performing the PWM control corresponding to the control inputs Us, Ud (S110). In S110, it is possible to perform the speed control in preference to the tension control by, for example, correcting the deviation Er or the control input Ur used for calculating the control inputs Us, Ud in accordance with, for example, a method of applying a coefficient of less than 1 to the deviation Er or the control input Ur.

When the second roller transport period is completed (S 120: Yes), the transport control device 60 estimates the non-tensional component RE2 (S130). Then, the transport control device 60 calculates the deviation Er=Rr−{(R1−RE1)−(R2−RE2)}/2 based on the reaction force with correction R2*=R2−RE2 obtained by removing the non-tensional component RE2 from the reaction force R2 and the non-tensional component RE1=R1+R2* calculated from the sum of the reaction force R1 and the reaction force with correction R2*, and computes the control input Ur based on the deviation Er. Further, the transport control device 60 calculates the control inputs Us, Ud by using this control input Ur and the control input Uv based on the deviation Ev=Vr−(V1+V2)/2, an controls the speed and tension for the paper Q to the target speed Vr and the target tension Rr>0 by the PWM control corresponding to the control inputs Us, Ud (S 140).

The transport control device 60 performs the control with the correction until the transport period using both rollers is completed. In a case that the operation proceeds to the first roller transport period after the end of the transport period using both rollers (S150: Yes), the transport control device 60 calculates the deviation Er=Rr−(R1−R2)/2 and then computes the control input Ur based on the deviation Er. Then, the transport control device 60 calculates the control inputs Us, Ud by using this control input Ur and the control input Uv based on the deviation Ev=Vr−(V1+V2)/2 to control the speed and tension for the paper Q to the target speed Vr and the target tension Rr=0 by the PWM control corresponding to the control inputs Us, Ud (S160). In S160, similar to S110, it is possible to perform the speed control in preference to the tension control. In a case that the first roller transport period is completed (S170: Yes), the control of transporting the paper Q is completed.

In the above description, the explanation has been made about the configuration and the operation of each of the transport control device 60 and the tension deviation calculating section 280 according to this embodiment. As a modified embodiment, the switch 282 may be configured such that the switch 282 does not output the value 0 as the non-tensional component RE2 in the first roller transport period, but inputs a value, which is the same as that of the transport period using both rollers, to the subtractor 283. Similarly, the switch 289 may be configured to output the value Rp=(R1+R2*)/2 input from the gain element 288 in any of the periods. In other words, the switch 289 may not be provided in the tension deviation calculating section 280. The tension deviation calculating section 280 may be configured to formally output the deviation Er=0 in any of the periods other than the transport period using both rollers.

Figure 8:
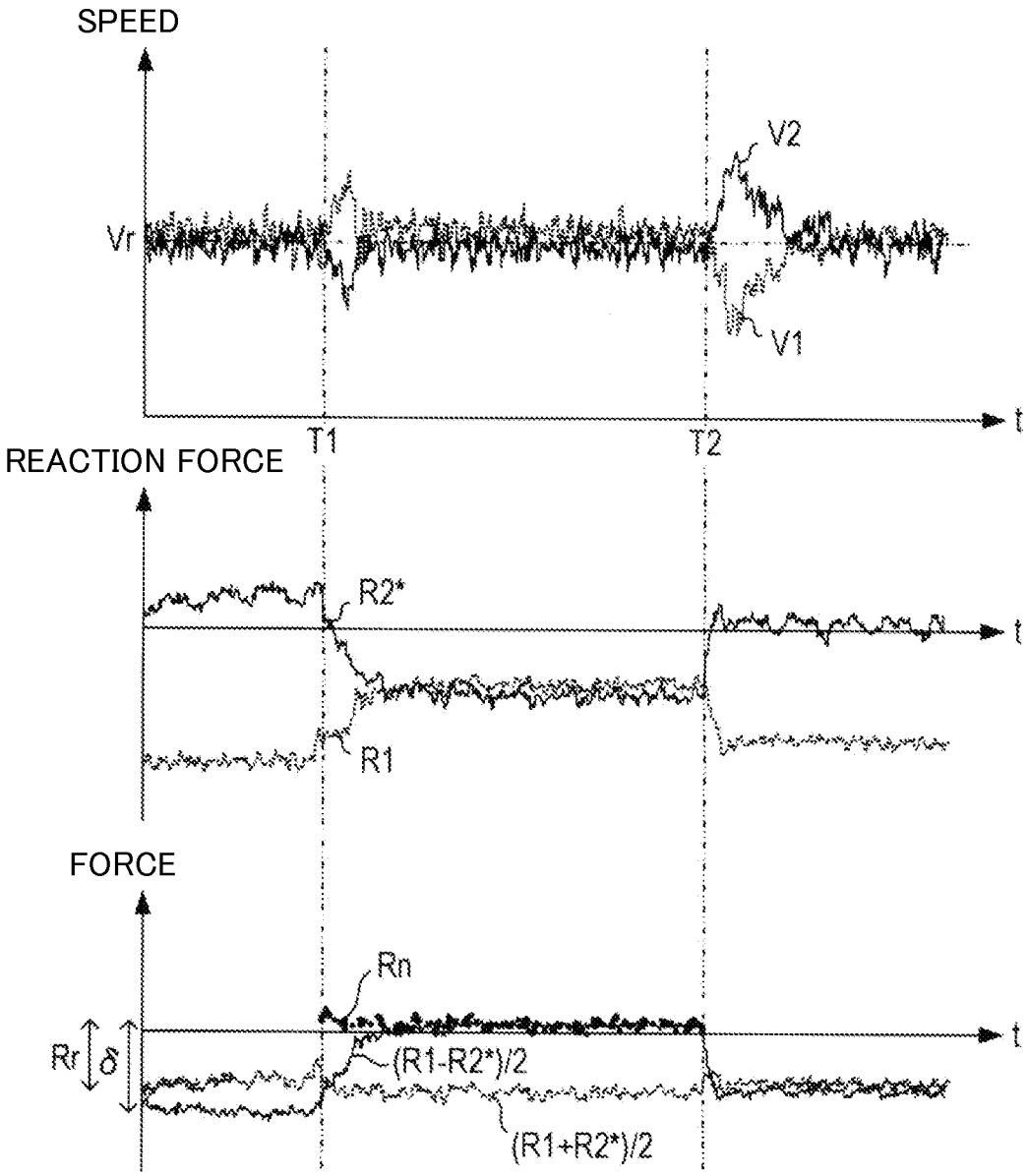
FIG. 8 shows graphs each illustrating changes in various parameters in transport control with correction performed by taking non-tensional component(s) into consideration.
Figure 9:
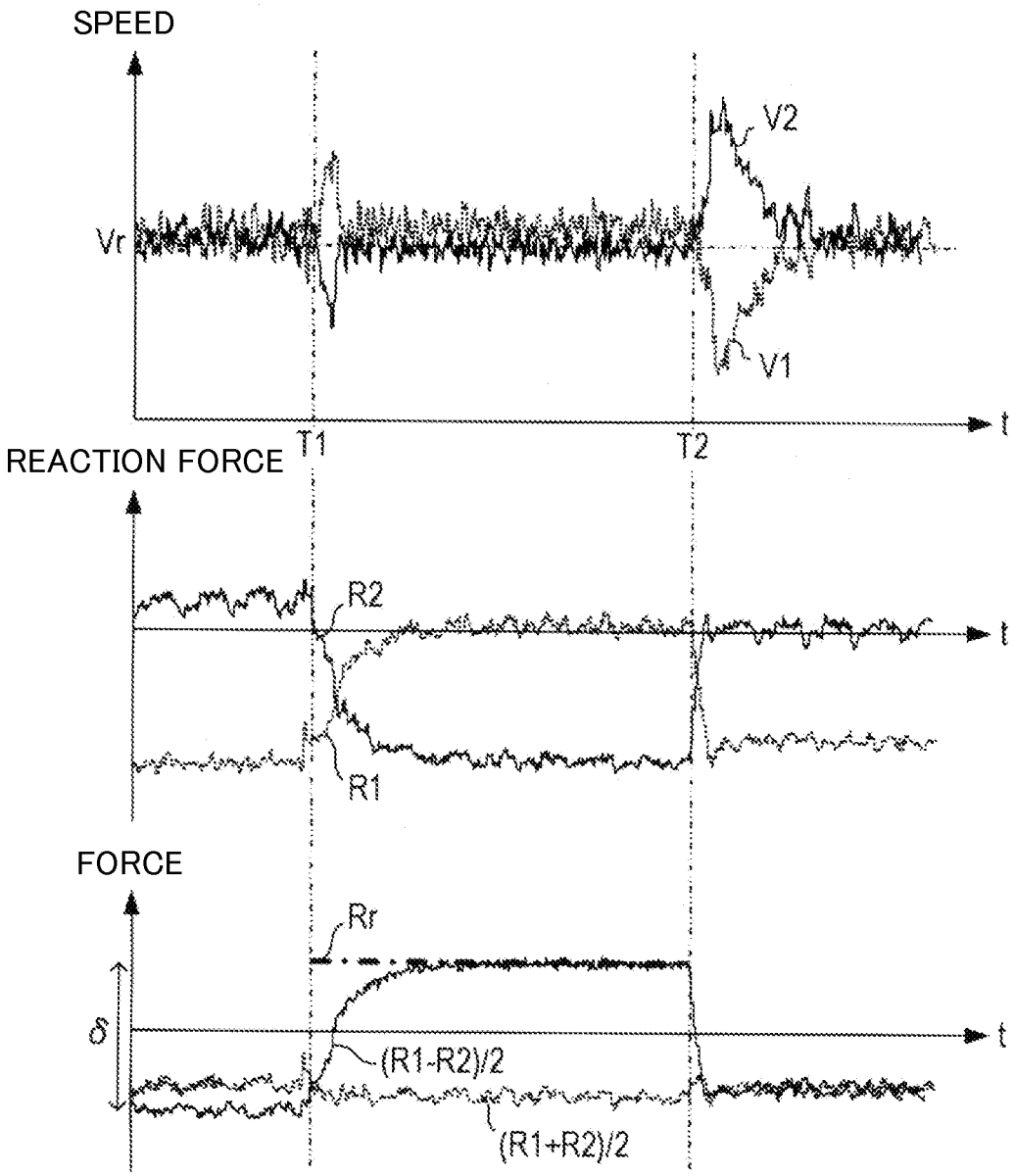
FIG. 9 shows graphs each illustrating changes in various parameters in transport control without the correction performed by taking the non-tensional component(s) into consideration.

FIG. 8 illustrates the change of various parameters in a first case in which the deviation Er obtained by taking the non-tensional components RE1, RE2 into consideration in the transport period using both rollers is calculated to perform the control of transporting the paper Q as in the above embodiment, and FIG. 9 illustrates the change of various parameters in a second case in which the deviation Er=Rr−Ra is calculated without taking the non-tensional components RE1, RE2 into consideration in the transport period using both rollers.

The graph shown on the upper side of FIG. 8 is a graph showing time-dependent changes in the rotation speed V1 of the first roller 110 (broken line) and the rotation speed V2 of the second roller 120 (solid line) in the first case. A period of time from the time t=0 to the time t=T1 corresponds to the second roller transport period, a period of time from the time t=T1 to the time t=T2 corresponds to the transport period using both rollers, a period of time after the time T2 corresponds to the first roller transport period. The graph shown on the upper side of FIG. 9 is a graph showing time-dependent changes in the rotation speed V1 (broken line) and the rotation speed V2 (solid line) in the second case.

Similarly, the graph shown at the center of FIG. 8 is a graph showing time-dependent changes in the reaction force R1 (broken line) and the reaction force R2 (solid line) estimated in the first case, and the graph shown at the lower side of FIG. 8 is a graph showing time-dependent changes in the sum (R1+R2*)/2 of the reaction force R1 and the reaction force with correction R2* (broken line), the difference (R1−R2*)/2 between the reaction force R1 and the reaction force with correction R2* (solid line), and the target tension with correction Rn (thick alternate long and short dash lines), in the first case.

The graph shown at the center of FIG. 9 is a graph showing time-dependent changes in the reaction force R1 (broken line) and the reaction force R2 (solid line) estimated in the second case, and the graph shown at the lower side of FIG. 9 is a graph showing time-dependent changes in the sum (R1+R2)/2 of the reaction force R1 and the reaction force R2 (broken line), the difference (R1−R2)/2 between the reaction force R1 and the reaction force R2 (solid line), and the target tension Rr (thick alternate long and short dash lines). To add a remark, FIGS. 8 and 9 respectively show experimental results obtained by intentionally incorporating the non-tensional components RE1, RE2 into the control system in order to clarify the effect.

In FIG. 9, the difference δ between a value in the second roller transport period and a value in the transport period using both rollers in the difference (R1−R2)/2 substantially corresponds to a tension F of the paper Q. In the second case, the deviation Er is calculated without correcting the estimated tension Ra=(R1−R2)/2 and the target tension Rr of the paper Q. Thus, although the difference (R1−R2)/2 follows the target tension Rr, a significant error is caused between the actual tension F of the paper Q and the target tension Rr.

On the other hand, in the first case, the deviation Er is calculated based on the target tension with correction Rn obtained by taking the non-tensional component RE1 into consideration and the estimated tension with correction Rm=(R1−R2*)/2 obtained by taking the non-tensional component RE2 into consideration. Thus, it is possible to prevent the error between the actual tension F of the paper Q and the target tension Rr. In FIG. 8, the difference δ between a value in the second roller transport period and a value in the transport period using both rollers in the difference (R1−R2*)/2 substantially corresponds to a value obtained by adding the non-tensional component RE2/2 to the tension F of the paper Q. Since the difference δ in FIG. 8 corresponds to a value obtained by adding the non-tensional component RE2/2 to the target tension Rr, the error between the actual tension F of the paper Q and the target tension Rr can be prevented in this embodiment.

According to this embodiment, the paper Q can be transported by two rollers 110, 120 while the speed and tension of the paper Q are controlled with high accuracy by controlling the first motor 73 and the second motor 83 by use of the sum of the control inputs Uv, Ur and the difference between the control inputs Uv, Ur. Therefore, it is possible to prevent deterioration in the quality of image formed in the paper Q which would be otherwise caused by the change in bending or curling of the paper Q, and it is possible to establish the image forming system 1 which is capable of forming a high-quality image in the paper Q.

According to this embodiment, the non-tensional components RE1, RE2 are estimated to correct the deviation Er properly in order to prevent the deterioration in control accuracy of the speed and tension of the paper Q which would be otherwise caused by the non-tensional components RE1, RE2. Accordingly, even when the non-tensional components RE1, RE2 are included in the reaction forces R1, R2, it is possible to perform the control of speed and tension of the paper Q with high accuracy.

The non-tensional components RE1, RE2 include, for example, paper resistance caused by deformation or flexure of the paper Q in a U-shaped transport path formed in the image forming system 1 and ranging from the paper feeding section 40 to the second roller 120. Further, the non-tensional components RE1, RE2 also include a component associated with the change in characteristics of a mechanical control system. According to the above embodiment, it is possible to perform the control with high accuracy while suppressing the above influences.

According to this embodiment, every time the paper Q is transported, the non-tensional component RE2 is estimated by using the reaction force R2 in each second roller transport period. Further, the non-tensional component RE1=2−Rp in the transport period using both rollers is estimated in real time by utilizing that the tensional component is eliminated in the sum (R1+R2*)/2. Then, the deviation Er is corrected based on the non-tensional components RE1, RE2, and consequently the control input Ur is corrected. Therefore, according to the above embodiment, the image forming system 1 can also address the changes of the non-tensional components in a short period of time caused by the paper resistance and the like properly, so as to control the speed and tension of the paper Q with high accuracy.

Other Embodiment(s)

The present teaching is not limited to the above embodiment, but can adopt various aspects. In the above embodiment, the image forming system 1 is configured as follows. That is, the rotation speed V1 of the first roller 110 and the rotation speed V2 of the second roller 120 are measured as a state quantity for the rotary motion of the first roller 110 and a state quantity for the rotary motion of the second roller 120, respectively, and the speed control of the paper Q is performed based on the measured values.

However, the image forming system 1 may be configured to perform position control of the paper Q based on the rotation amount X1 of the first roller 110 and the rotation amount X2 of the second roller 120 instead of the rotation speed V1 and the rotation speed V2. Further, the image forming system 1 may be configured to perform acceleration control of the paper Q based on a measurement value of the acceleration. The technique related to the paper transport is not limited to the image forming system, but can be applied to various sheet transport systems.

The transport control device 60 may be configured as a dedicated communication circuit such as ASIC or may be configured by a microcomputer. In this case, the transport control device 60 may be configured as follows. That is, the transport control device 60 includes a CPU 61 and a ROM 63 as shown in FIG. 2 and achieves the function of each of the elements provided for the transport control device 60 by letting the CPU 61 execute the process in accordance with each of the programs stored in the ROM 63.

Correspondence or Correlation

The correspondence or correlation between the terms is as follows. The first driving circuit 71 and the first motor 73 correspond to an example of a first driving device. The second driving circuit 81 and the second motor 83 correspond to an example of a second driving device. The first encoder 75 and the first signal processing circuit 77 correspond to an example of a first measuring device. The second encoder 85 and the second signal processing circuit 87 correspond to an example of a second measuring device.

Further, the transport control device 60 corresponds to an example of a control device. In particular, the first reaction-force estimating section 260 and the second reaction-force estimating section 330 correspond to a first estimating unit and a second estimating unit respectively. The speed deviation calculating section 220 and the speed controller 230 correspond to an example of a first computing unit. The tension deviation calculating section 280 and the tension controller 300 correspond to an example of a second computing unit. The non-tensional component estimating section 281 corresponds to an example of a third estimating unit.

Further, the first control input calculating section 240 and the first PWM signal generating section 250 correspond to an example of a first driving control unit. The second control input calculating section 310 and the second PWM signal generating section 320 correspond to an example of a second driving control unit. The ink-jet head 31 corresponds to an example of an image forming device.

What is claimed is:

1. A transport system configured to transport a sheet, comprising:

a transport mechanism including a first roller and a second roller which are arranged apart from each other along a transport path of the sheet to transport the sheet in a transport direction;

a first driving device configured to rotate the first roller;

a second driving device configured to rotate the second roller;

a first measuring device configured to measure a state quantity Z1 concerning a rotary motion of the first roller;

a second measuring device configured to measure a state quantity Z2 concerning a rotary motion of the second roller; and a controller configured to control an operation of transporting the sheet with rotations of the first roller and the second roller by controlling the first driving device and the second driving device;

the controller being configured to perform:

estimating a reaction force R1 acting on the first roller in a case that the first roller is rotated by the first driving device;

estimating a reaction force R2 acting on the second roller in a case that the second roller is rotated by the second driving device;

calculating a control input U1 in accordance with a deviation between a target state quantity and a state quantity of the sheet (Z1+Z2)/2, based on the state quantity Z1 measured by the first measuring device and the state quantity Z2 measured by the second measuring device;

calculating a control input U2 in accordance with a deviation between a target tension and an estimated tension of the sheet (R1−R2)/2, based on the reaction force R1 and the reaction force R2;

inputting, to the first driving device, a control signal in accordance with a sum (U1+U2) of the control input U1 and the control input U2;

inputting, to the second driving device, a control signal in accordance with a difference (U1−U2) between the control input U1 and the control input U2;

estimating a non-tensional component RE1 which is a component included in the reaction force R1 estimated by the first estimating unit and unrelated to tension of the sheet, based on the reaction force R1 estimated by the first estimating unit during a first period of time in which the sheet is transported only by the first roller from among the first roller and the second roller, or a non-tensional component RE2 which is a component included in the reaction force R2 estimated by the second estimating unit and unrelated to tension of the sheet, based on the reaction force R2 estimated by the second estimating unit during a second period of time in which the sheet is transported only by the second roller from among the first roller and the second roller; and correcting the control input U2 to prevent a control error caused by the non-tensional component RE1 and the non-tensional component RE2 included in the estimated tension of the sheet (R1−R2)/2, during a third period of time in which the sheet is transported by both of the first roller and the second roller, based on the non-tensional component RE1 or the non-tensional component RE2.

2. The transport system according to claim 1, wherein the controller is configured to perform:

calculating a difference between a sum (R1+R2) of the reaction force R1 and the reaction force R2, and one of the non-tensional component RE1 and the non-tensional component RE2;

estimating the other of the non-tensional component RE1 and the non-tensional component RE2 based on the difference obtained from the calculation; and correcting the control input U2 by using the one of the non-tensional component RE1 and the non-tensional component RE2 and the other of the non-tensional component RE1 and the non-tensional component RE2 estimated based on the difference obtained from the calculation.

3. The transport system according to claim 2, wherein the controller is configured to perform:

correcting the estimated tension (R1−R2)/2 used for calculating the control input U2 to an estimated tension {(R1−RE1)−(R2−RE2)}/2;

calculating a control input U2 with correction in accordance with a deviation between the target tension and the estimated tension {(R1−RE1)−(R2−RE2)}/2; and correcting the control input U2 to the control input U2 with correction based on a result of the calculation.

4. The transport system according to claim 2, wherein the controller is configured to correct the control input U2 by performing a calculation process of the control input U2 after correcting the target tension or both of the target tension and the estimated tension (R1−R2)/2, the calculation process being equivalent to a calculation of the control input U2 performed after correcting the estimated tension (R1−R2)/2 to an estimated tension {(R1−RE1)−(R2−RE2)}/2.

5. The transport system according to claim 1, wherein the first roller is positioned downstream of the second roller in the transport direction;

the controller is configured to perform:

estimating the non-tensional component RE2 based on the reaction force R2 during a period of time in which the sheet is transported by the second roller and a front end of the sheet has not yet arrived at the first roller; and correcting the control input U2 during a period of time in which the sheet is transported by both of the first roller and the second roller after the front end of the sheet has arrived at the first roller, based on the non-tensional component RE2 estimated by using the reaction force R2, which is estimated immediately before completion of the period of time in which the sheet is transported by the second roller and the front end of the sheet has not yet arrived at the first roller.

6. The transport system according to claim 5, wherein the controller is configured to estimate, as the non-tensional component RE2, the reaction force R2 estimated immediately before the sheet is transported by both of the first roller and the second roller.

7. The transport system according to claim 1, wherein the controller is configured to perform:

calculating a representative value of the reaction forces R1 in the first period of time, based on a group of the reaction forces R1 estimated by the first estimating unit during the first period of time; and estimating the representative value as the non-tensional component RE1; or calculating a representative value of the reaction forces R2 during in the second period of time, based on a group of the reaction forces R2 estimated by the second estimating unit during the second period of time; and estimating the representative value as the non-tensional component RE2.

8. The transport system according to claim 7, wherein the representative value is one of an average value, a median value, and a mode value of the group of the reaction forces R1 or the reaction forces R2.

9. The transport system according to claim 1, wherein the first measuring device is configured to measure a rotation speed of the first roller as the state quantity Z1;

the second measuring device is configured to measure a rotation speed of the second roller as the state quantity Z2; and the controller is configured to calculate the control input U1 in accordance with the deviation between a speed of the sheet as the state quantity of the sheet (Z1+Z2)/2 and a target speed of the sheet as the target state quantity.

10. The transport system according to claim 1, wherein the transport mechanism further includes a first driven roller arranged to face the first roller and a second driven roller arranged to face the second roller; and the transport mechanism is configured to perform:

transporting the sheet with the rotation of the first roller while nipping the sheet between the first roller and the first driven roller; and transporting the sheet with the rotation of the second roller while nipping the sheet between the second roller and the second driven roller.

11. The transport system according to claim 1, wherein an image forming device configured to form an image on the sheet by discharging ink droplets is provided above the transport path; and the first roller and the second roller are arranged in the transport path across a section which is defined within the transport path and above which the image forming device is provided.

12. An image forming system, comprising:

an image forming device provided above a transport path of a sheet and is configured to discharge ink droplets to form an image on the sheet;

a transport mechanism including a first roller and a second roller configured to transport the sheet and arranged in the transport path across a section which is defined within the transport path and above which the image forming device is provided;

a first driving device configured to rotate the first roller;

a second driving device configured to rotate the second roller;

a first measuring device configured to measure a rotation speed Z1 of the first roller;

a second measuring device configured to measure a rotation speed Z2 of the second roller; and a controller configured to control an operation of transporting the sheet with rotations of the first roller and the second roller by controlling the first driving device and the second driving device, the controller being configured to perform:

estimating a reaction force R1 acting on the first roller in a case that the first roller is rotated by the first driving device;

estimating a reaction force R2 acting on the second roller in a case that the second roller is rotated by the second driving device;

calculating a control input U1 in accordance with a deviation between a target speed and a speed of the sheet (Z1+Z2)/2, based on the rotation speed Z1 measured by the first measuring device and the rotation speed Z2 measured by the second measuring device;

calculating a control input U2 in accordance with a deviation between a target tension and an estimated tension of the sheet (R1−R2)/2, based on the reaction force R1 and the reaction force R2;

inputting, to the first driving device, a control signal in accordance with a sum (U1+U2) of the control input U1 and the control input U2;

inputting, to the second driving device, a control signal in accordance with a difference (U1−U2) between the control input U1 and the control input U2;

estimating a non-tensional component RE1 which is a component included in the estimated reaction force R1 and unrelated to tension of the sheet, based on the reaction force R1 estimated during a first period of time in which the sheet is transported only by the first roller from among the first roller and the second roller, or a non-tensional component RE2 which is a component included in the estimated reaction force R2 and unrelated to tension of the sheet, based on the reaction force R2 estimated during a second period of time in which the sheet is transported only by the second roller from among the first roller and the second roller; and correcting the control input U2 so as to prevent a control error caused by the non-tensional component RE1 and the non-tensional component RE2 included in the estimated tension of the sheet (R1−R2)/2, during a third period of time in which the sheet is transported by both of the first roller and the second roller, based on the non-tensional component RE1 or the non-tensional component RE2.

13. A controller configured to control an operation of transporting a sheet by controlling a first driving device configured to rotate a first roller and a second driving device configured to rotate a second roller, in a transport mechanism configured to achieve the operation of transporting the sheet with rotations of the first roller and the second roller which are arranged apart from each other along a transport path of the sheet, the controller configured to perform:

estimating a reaction force R1 acting on the first roller in a case that the first roller is rotated by the first driving device;

estimating a reaction force R2 acting on the second roller in a case that the second roller is rotated by the second driving device;

calculating, based on a state quantity Z1 concerning a rotary motion of the first roller and a state quantity Z2 concerning a rotary motion of the second roller which are measured by a measuring device, a control input U1 in accordance with a deviation between a target state quantity and a state quantity of the sheet (Z1+Z2)/2;

calculating a control input U2 in accordance with a deviation between a target tension and an estimated tension of the sheet (R1−R2)/2, based on the reaction force R1 and the reaction force R2;

inputting, to the first driving device, a control signal in accordance with a sum (U1+U2) of the control input U1 and the control input U2;

inputting, to the second driving device, a control signal in accordance with a difference (U1−U2) between the control input U1 and the control input U2;

estimating a non-tensional component RE1 which is a component included in the estimated reaction force R1 and unrelated to tension of the sheet, based on the reaction force R1 estimated during a first period of time in which the sheet is transported only by the first roller from among the first roller and the second roller, or a non-tensional component RE2 which is a component included in the estimated reaction force R2 and unrelated to tension of the sheet, based on the reaction force R2 estimated during a second period of time in which the sheet is transported only by the second roller from among the first roller and the second roller; and correcting the control input U2 to prevent a control error caused by the non-tensional component RE1 and the non-tensional component RE2 included in the estimated tension of the sheet (R1−R2)/2, during a third period of time in which the sheet is transported by both of the first roller and the second roller, based on the non-tensional component RE1 or the non-tensional component RE2.

* * * * *